US006443801B1

(12) United States Patent
Bell

(10) Patent No.: US 6,443,801 B1
(45) Date of Patent: Sep. 3, 2002

(54) SPINNING TOP

(76) Inventor: Dale L. Bell, 6461 Garden Rd., Riviera Beach, FL (US) 33404

( * ) Notice: Subject to any disclaimer, the term of this patent is extended or adjusted under 35 U.S.C. 154(b) by 0 days.

(21) Appl. No.: 09/812,610

(22) Filed: Mar. 20, 2001

(51) Int. Cl.[7] ..... A63H 1/06
(52) U.S. Cl. ..... 446/256; 446/236; 446/257
(58) Field of Search ..... 446/236, 241, 446/256, 257, 258, 259, 260, 261, 262, 263, 264, 265, 266

(56) References Cited

U.S. PATENT DOCUMENTS 1,616,224 A * 2/1927 Kleinman ..... 446/264
1,695,807 A * 12/1928 Klienman ..... 446/264
2,177,878 A * 10/1939 Savage ..... 446/153
2,616,213 A * 11/1952 Kondrath ..... 446/261
3,201,896 A * 8/1965 Dalhardt ..... 446/257
4,129,961 A 12/1978 Parodi
4,772,241 A * 9/1988 Bro et al. ..... 446/202
4,891,031 A * 1/1990 Beaudry ..... 446/256
4,960,401 A 10/1990 Ross
5,498,192 A * 3/1996 McKay et al. ..... 446/236
6,146,233 A 11/2000 Hedeen, Jr.

* cited by examiner

*Primary Examiner*—Jacob K. Ackun
*Assistant Examiner*—Faye Francis
(74) *Attorney, Agent, or Firm*—Charles J. Prescott

(57) ABSTRACT

A spinning top including a hollow body having a vertical spin axis and including an upper and a lower body portion rigidly connected together directly or preferably interconnected by a weighted annular ring for increased rotational inertia. A replaceable pointed tip is connected to the lower end of the lower body portion for free rotation only with respect to the body, the pointed tip engaging against a support surface when the body is in spinning motion. A second bearing-mounted pointed tip may be releasably connected concentric with the spin axis and upwardly extending from an upper end of the upper body portion whereby the spinning top may be lifted from one support surface and placed onto another support surface without interrupting spinning motion of the top.

4 Claims, 3 Drawing Sheets

SPINNING TOP

BACKGROUND OF THE INVENTION

1. Scope of Invention

This invention relates generally to spinning tops, and more particularly to a spinning top having a precision bearing which provides free relative rotation for a replaceable lower tip of the spinning top for enhanced performance.

2. Prior Art

The spinning top has been long known as an enjoyable toy for both children and adults. Such a spinning top includes a concentrically balanced body, typically tapered to a lower point or tip. The top, when spun rapidly as released, will continue to spin atop a support surface on the lower tip for an extended time period depending upon initial speed, inertia and friction. These conventional spinning tops are used in conjunction with a length of string which is wrapped tightly around the lower portion of the top and then thrown with the proximal end of the string being held between the fingers. The spinning top is released from the string in a rapidly spinning motion and, by gyroscopic effect, maintains the released orientation of the spin axis, which spinning motion continues as the top comes to rest on a support surface at the lower distal end of the top.

An improved pull-string attachment system is disclosed by Hedeen in U.S. Pat. No. 6,146,233 wherein the pull string has a toothed catch at one end which engages with a cylindrical hub of the top. This arrangement results in the string being wound within a deep radial groove transverse to the spin axis rather than the string being wound on the exterior lower surface of the top.

In U.S. Pat. No. 4,960,401, Ross teaches a spinning top having a minimal size and weight which, when used in combination with a coin, exhibits significantly improved spinning and balance properties. Parodi has also invented a spinning top in U.S. Pat. No. 4,129,961 which includes a flexible belt or strap to impart spinning rotation replacing the conventional string or cord.

The present invention enhances the spinning capability of a spinning top by the addition of a precision bearing positioned between a pointed replaceable lower tip of the spinning top and the lower body portion of the hollow body of the top. This bearing arrangement significantly increases the time for free spinning of the top while also facilitating the easy replacement of worn lower pointed tips. Additionally an annular ring is also provided formed of a substantially higher density material such as brass which greatly enhances the rotational inertia of the spinning top without a proportionate increase in overall weight, the hollow body being molded of plastic material to mob achieve a more optimal inertia/weight relation.

BRIEF SUMMARY OF THE INVENTION

This invention is directed to a spinning top including a balanced hollow body having a vertical spin axis and including an upper and a lower body portion rigidly connected together directly or preferably interconnected by a weighted annular ring for increased rotational inertia. A replaceable pointed tip is connected to the lower end of the lower body portion for free rotation with respect to the body, the pointed tip engaging against a support surface when the body is placed into a spinning motion. A second bearing-mounted upper pointed tip may be releasably connected concentric with the spin axis and upwardly extending from an upper end of the upper body portion whereby the spinning top may be lifted from one support surface and placed onto another support surface without interrupting spinning motion of the top.

It is therefore an object of this invention to provide a spinning top with extended rotational time after being spun and released.

It is yet another object of this invention to provide a replaceable lower pointed tip of a spinning top which is also bearing-mounted for free rotation with respect to the body of the spinning top for enhanced rotational characteristics by the reduction of friction both at the pointed tip on a support surface and between the pointed tip and the body of the spinning top.

It is still another object of this invention to provide a spinning top with a disproportionately high ratio of rotational inertia to weight as facilitated by the addition of an annular ring or band of substantially higher density material than that utilized in mold-forming plastic body of the spinning top.

Yet another object of this invention is to provide a pointed tip attached to both upper and lower ends of a spinning top, each pointed tip being held for free relative rotation with respect to the body of the spinning top for enhanced usage opportunities.

In accordance with these and other objects which will become apparent hereinafter, the instant invention will now be described with reference to the accompanying drawings.

DETAILED DESCRIPTION OF THE INVENTION

Figure 1:
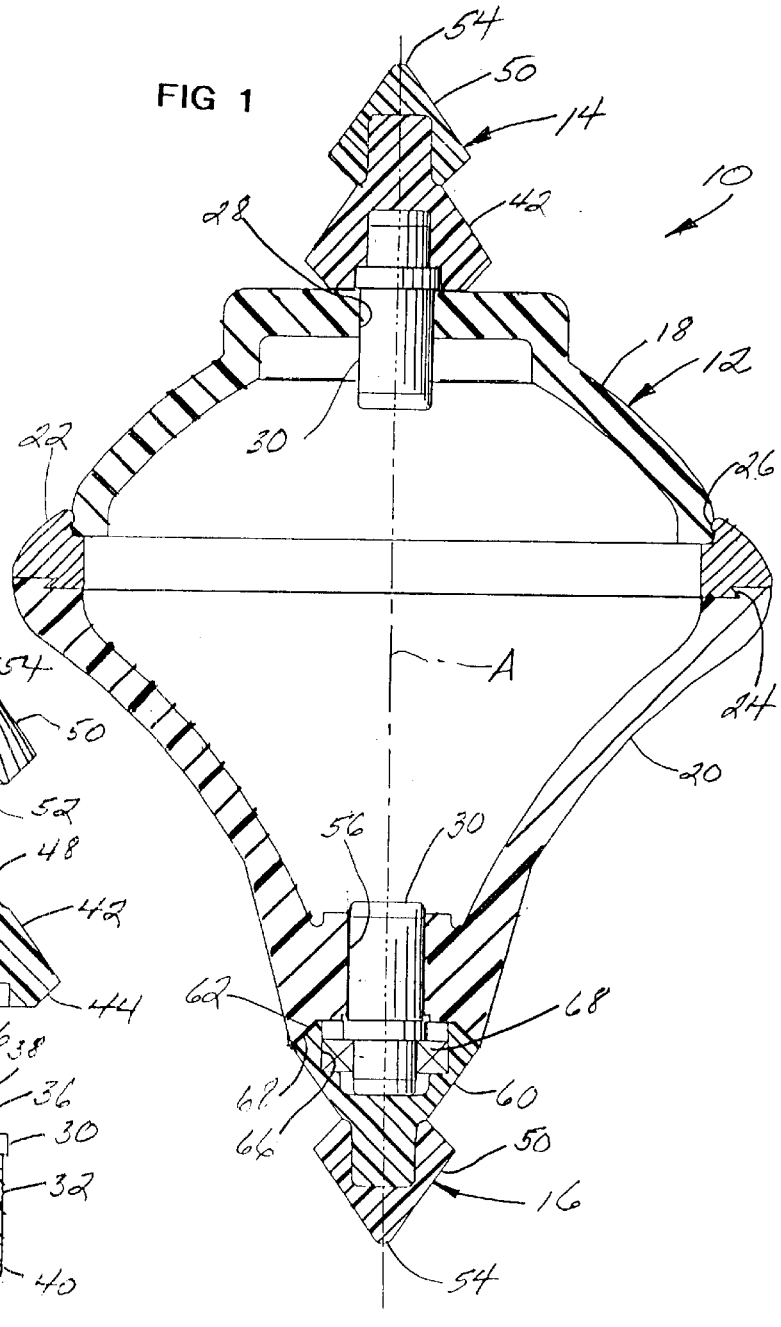
FIG. 1 is a longitudinal section view of one embodiment of the invention.

Referring now to the drawings, one embodiment of the invention is generally shown at numeral 10 in FIG. 1. The spinning top 10 includes a hollow body 12 formed of plastic molded upper and lower body portions 18 and 20, respectively, which are uniformly symmetric and balanced about the spinning axis A of the top 10.

In this embodiment 10, an annular ring 22 is provided for interconnecting the upper and lower body halves 18 and 20, respectively. When mold-forming the lower body portion 20, the weighted ring 22 is mechanically locked at 24 to the upper margin of the lower body portion 20. The upper body portion 18 is then forcibly assembled into the weighted ring 22 and mechanically locked together by the interference fit at 26.

The weighted ring 22 is formed of a material such as brass having a substantially higher density than that of the molded plastic material utilized to form the upper and lower body portions 18 and 20, respectively. By utilizing such a higher density material for forming the weighted ring 22, a higher rotational inertia is achieved while avoiding excess weight of the body 12 of the spinning top 10 itself.

In this spinning top embodiment 10, the lower tip assembly 16 includes a replaceable pointed tip 54 which is freely rotatable about the spinning axis A with respect to the body 12. As best also seen in FIG. 4, the replaceable pointed tip 50 is forcibly urged by interference fit onto the lower cylindrical surface 64 of intermediate tip assembly member 60. Again, the diameter between surface 52 and surface 64 are selected to establish a sufficient interference fit so that the replaceable tip 50 will remain in place during normal use, but will also be removable when the lower point 54 becomes sufficiently worn so as to adversely affect the frictional characteristics of the spinning top 10.

A mounting shaft 30 includes an elongated cylindrical portion 32 which is forcibly urged into cylindrical aperture or cavity 56 of the lower body portion 20. Distal end 40 is slightly reduced in diameter to facilitate assembly insertion of the cylindrical portion 32 into cavity 56. The other cylindrical portion 36 of mounting shaft 30 is forcibly urged into the inner race of a miniature ball bearing 68, shoulder 34 serving as an assembly stop. The outer diameter of bearing 68 is forcibly urged into cylindrical cavity 66. The other distal end 38 of shaft 30 is slightly reduced in diameter, again for assembly insertion of cylindrical end portion 36 into the bearing 68. The truncated conical surface 62 of intermediate member 60 mates with and receives alignment and support from surface 68 defining the lower end of lower body portion 20. Applicant has found that the preferred miniature bearing 68 is commercially available from National Precision Ball Bearing Corporation, having an o.d. of 0.375" and an i.d. of 0.187" and a width of 0.125".

Figure 4:
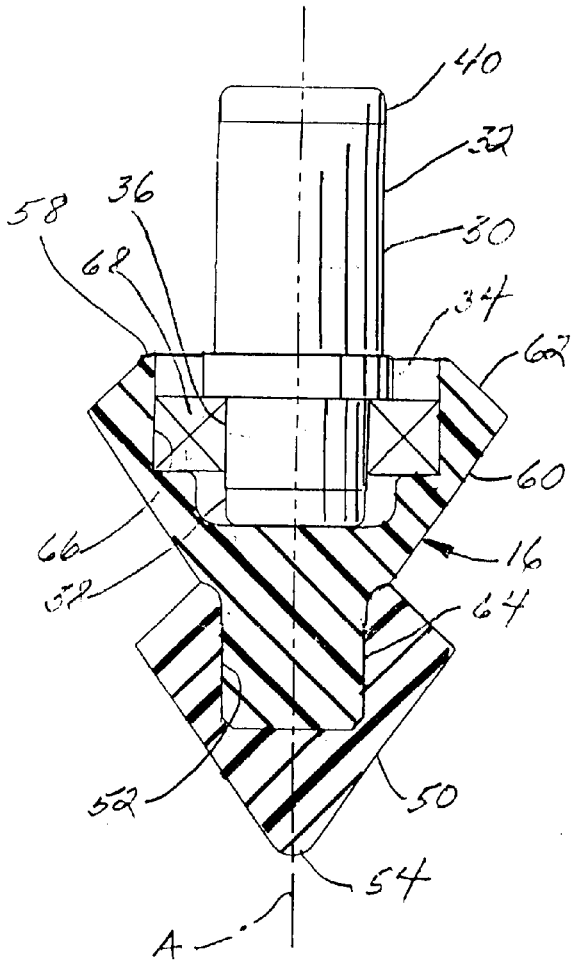
FIG. 4 is an enlarged section view of the freely rotatable lower pointed tip of FIG. 1.

To help insure that bearing 68 is not inadvertently dislodged from cylindrical cavity 66, the distal margin 58, as best seen in FIG. 4, may be hot punched rather than relying only upon a press or interference fit between the bearing 68 and surface 66. This hot punch process is preferred and is accomplished prior to the insertion of cylindrical portion 32 into the cylindrical cavity 56.

By this arrangement, the pointed tip 50 is made freely rotatable about the spin axis A with respect to the body 12, while remaining easily replaceable when the lower point 54 becomes sufficiently worn so as to be a detriment to the spinning time due to friction build-up between the worn tip and a support surface.

Figure 2:
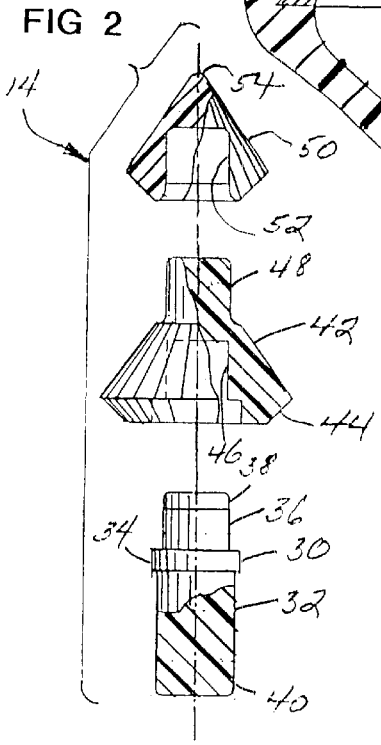
FIG. 2 is an enlarged and exploded view of the upper pointed tip assembly of FIG. 1.
Figure 3:
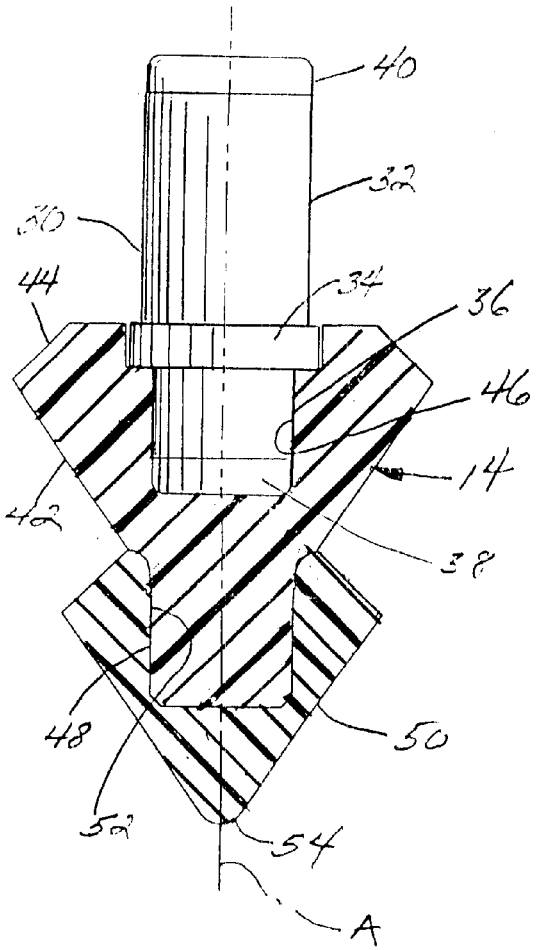
FIG. 3 is an enlarged view of the fixed upper pointed tip of FIGS. 1 and 2.

As best seen in FIGS. 1, 2 and 3, the upper tip assembly 14 is held stationary with respect to body 12. The same molded plastic pointed tip 50 is press-fitted onto the cylindrical surface 48 of intermediate body 42 as above described. However, one cylindrical portion 36 of shaft 30 is press-fitted into cylindrical cavity 46 of intermediate member 42 to establish a rigid, permanent connection therebetween. Shoulder 34 serves as an assembly stop and establishes the axial relative positioning between the shaft 30. and intermediate member 42. The other cylindrical portion 32 is press-fitted into aperture 28 formed concentrically about the spin axis A in the upper body portion 18.

Although most users of this embodiment 10 will prefer to cause the spinning top 10 to be rotated about its spinning axis A with the pointed tip assembly 16 oriented downwardly for enhanced spin characteristics due to the freely rotatable qualities of the lower tip 50, nonetheless a user may also invert the spinning top 10 so that the fixed pointed tip assembly 14 is downwardly oriented. This may occur when the point 54 of assembly 16 becomes excessively worm, in which case, the new tip 54 of tip assembly 14 may provide for short-term improved spinning qualities until the worn tip 54 of the lower tip assembly 16 is replaced. Pick-up of a spinning top 10 in motion is also facilitated as described herebelow.

Figure 5:
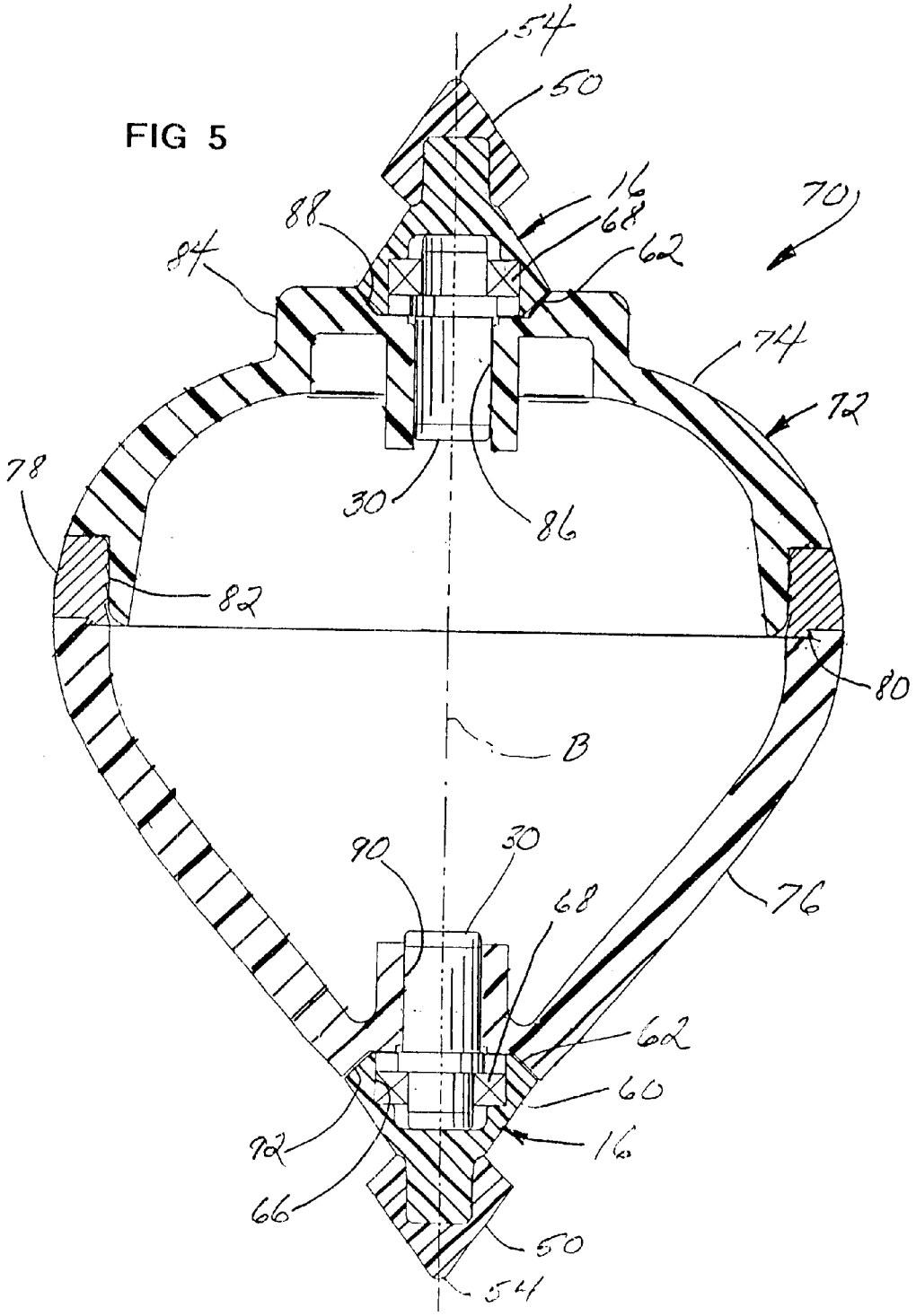
FIG. 5 is a longitudinal section view of another embodiment of the invention including freely rotatable upper and lower tips thereof.

In FIG. 5, another and preferred embodiment of the spinning top is shown generally at numeral 70. This spinning top 70 includes a hollow body 72 having upper and lower molded plastic body portions 74 and 76, respectively, which are interconnected together by a brass annular ring 78. As previously described, interlocking structure 80 establishes a permanent connection between the lower plastic molded body portion 76 and annular ring 78 during the molding process of the lower body portion 76. Thereafter, the locking structure at 82 between the inner surface of the annular ring 78 and the mating surface of the molded plastic upper body portion 74 establishes permanent engagement therebetween on final assembly between the upper and lower body portions 74 and 76. The entire body 74 is concentric and balanced about the spinning axis B as previously described in previous embodiment 10. Denser brass material is preferred in forming the annular ring 78 for enhanced rotational inertia properties by placing the denser brass material furthest from the spin axis B.

In this spinning top 70, both the upper and lower tip assemblies 16 as previously described are formed of molded plastic and are lockingly engaged by cylindrical portion 32 mounting shaft 30 into the respective cavities 86 and 90 of the upper and lower body portions 74 and 76, respectively. All other aspects of each of the tip assemblies 16 themselves and with respect to mating surfaces 88 and 92 are also as previously-described.

By providing a relatively frictionless, freely rotatable pointed tip 50 at both the upper and lower ends of the spinning top 70, the user may lift the spinning top 70 while it is spinning in gyroscopic balanced operation atop a support surface by grasping the pointed tip 50 of the upper tip assembly and then replacing the spinning top 70 onto another surface. Because of the freely rotatable relationship between the upper tip 50 and the body 72, very little spin inertia is lost during such a pick-up and transfer of the spinning top 70. This beneficial dual rotating tip feature provides many additional performance opportunities for the consummate spinning top aficionado.

While the instant invention has been shown and described herein in what are conceived to be the most practical and preferred embodiments, it is recognized that departures may be made there from within the scope of the invention, which is therefore not to be limited to the details disclosed herein, but is to be afforded the full scope of the claims so as to embrace any and all equivalent apparatus and articles.

What is claimed is:

1. A spinning top comprising:

a hollow body having a vertical spin axis and including an upper and a lower body portion and an annular ring positioned between and rigidly interconnecting said upper and lower body portions together;

said lower body portion having a longitudinal aperture or recess formed concentric with said spin axis at a lower end of said lower body portion;

a replaceable pointed tip connected to said aperture or recess for free rotation only with respect to said body, said pointed tip engaging against a support surface while said body is in spinning motion;

said annular ring formed of material having a density substantially greater than that of said upper and lower body portions to provide substantially increased rotational inertia of said spinning top.

2. A spinning top as set forth in claim 1, further comprising:

a second pointed tip connected to another aperture or recess forned concentric with said spin axis at an upper end of said upper body portion, said second pointed tip engageable separately from said pointed tip at said lower end against the support surface while each body is in spinning motion.

3. A spinning top comprising:

a hollow body having a vertical spin axis and including an upper and a lower body portion and an annular ring positioned concentrically with said spin axis between and rigidly interconnecting said upper and lower body portions together;

said lower body portion having a longitudinal aperture or recess formed concentric with said spin axis at a lower end of said lower body portion;

a tip assembly concentric with said spin axis and including a replaceable pointed tip releasably connected to an intermediate tip member, and a mounting shaft connected between said intermediate tip member and said aperture or recess for free rotation only with respect to said mounting shaft, said pointed tip engaging against a support surface while said body is in spinning motion;

said annular ring formed of material having a density substantially greater than that of said upper and lower body portions to provide substantially increased rotational inertia of said spinning top.

4. A spinning top as set forth in claim 3, further comprising:

a second pointed tip connected to another aperture or recess formed concentric with said spin axis at an upper end of said upper body portion, said second pointed tip engageable separately from said pointed tip at said lower end against the support surface while each body is in spinning motion.

* * * * *